United States Patent [19]

Kupperman et al.

[11] 4,263,731

[45] Apr. 28, 1981

[54] DESK SET

[75] Inventors: Sam Kupperman, Chicago; Dennis Kupperman, Glenview, both of Ill.

[73] Assignee: RB Toy Development Co., Skokie, Ill.

[21] Appl. No.: 13,981

[22] Filed: Feb. 22, 1979

Related U.S. Application Data

[63] Continuation-in-part of Ser. No. 883,915, Mar. 6, 1978, abandoned.

[51] Int. Cl.[3] ..... G09D 3/08

[52] U.S. Cl. ..... 40/113

[58] Field of Search ..... 40/358, 113, 495, 124.1, 40/120; 402/135

[56] References Cited

U.S. PATENT DOCUMENTS

| | | | |
|---|---|---|---|
| 579,257 | 3/1897 | Colby | 40/113 |
| 780,198 | 1/1905 | Keplinger | 40/113 |
| 1,481,333 | 1/1924 | Agar | 40/124.1 X |
| 1,727,440 | 9/1929 | Meyer | 40/107 |
| 1,831,712 | 11/1931 | Keenan | 40/358 X |
| 2,550,857 | 5/1951 | Overbaugh | 40/124.1 |
| 2,828,565 | 4/1958 | Goldstein | 40/124.1 |
| 3,463,323 | 8/1969 | Riepe | 401/131 |
| 3,558,138 | 1/1971 | Lemelson | 46/25 |

FOREIGN PATENT DOCUMENTS

| | | | |
|---|---|---|---|
| 1531418 | 5/1968 | France | 40/358 |
| 709905 | 6/1954 | United Kingdom | 40/113 |

*Primary Examiner*—Gene Mancene
*Assistant Examiner*—Wenceslao J. Contreras
*Attorney, Agent, or Firm*—Vogel, Dithmar, Stotland, Stratman & Levy

[57] ABSTRACT

A desk set of all plastic material with a base having front and rear surfaces and spaced apart openings therein with an instrument holder near one end of the base. The instrument holder has three hoops, one extending forwardly of the base and the other extending rearwardly of the base and each vertically spaced with respect to each other and a cone-shaped hoop at the bottom of the instrument holder extending forwardly of the base. A ledge extends rearwardly of the base at the bottom of the instrument holder providing a support surface. Two discs with indicia are rotatably mounted on the base so that a portion of each disc is in registry with a respective one of the openings in the base, and in one embodiment a rear brace maintains the discs in position. A brace extends rearwardly of the base to maintain the base in an upright position.

8 Claims, 13 Drawing Figures

DESK SET

RELATED APPLICATIONS

This application is a continuation-in-part of our copending patent application, Ser. No. 883,915, filed Mar. 6, 1978 now abandoned, the disclosure of which is incorporated herein by reference.

BACKGROUND OF THE INVENTION AND PRIOR ART STATEMENT

Desk sets which show the date consisting of the month and day as well as providing storage for writing instruments are notoriously old in the art. Many such devices are available, some of which are elaborately ornate including time pieces as well as other devices such as calculators and the like. The general concept of a device providing data information as well as writing instrument storage is old; however, there has not yet been provided a desk set which is suitable for use as a premium item to be included in cereal packages for ultimate use by youngsters.

The prior art desk sets referred to above, generally are expensive, large and heavy. No desk set has been made available which is light weight, inexpensive to manufacture, easy to assemble and yet will function in all respects as a desk set to provide both instrument storage as well as the month and day information. Further, the desk set of the present invention must be sufficiently large to pass FDA size requirements, yet at the same time be of sufficient design to enable large numbers, in the millions, to be produced at relatively low cost.

SUMMARY OF THE INVENTION

This invention relates to a desk set of all plastic material and more particularly this invention relates to an integral one-piece molded unit which can easily be assembled into a desk set providing both instrument storage and the month and date information.

An important object of the present invention is to provide a light weight, inexpensive and easy to assemble one-piece construction which a child can construct into a desk set providing both instrument storage as well as month and date information.

Another object of the present invention is to provide a desk set of all plastic material comprising a base having a front surface, a rear surface and spaced apart openings therein, an instrument holder near one end of the base, the holder comprised of spaced apart vertically extending straps interconnected by horizontally arcuate strips, an inverted hollow cone-shaped member forming the bottom of the holder extending outwardly from the front surface of the base and a ledge extending rearwardly from the bottom of the cone-shaped member, two discs carrying thereon indicia indicating the month and day, means rotatably mounting the discs to the base such that a portion of each disc is visible through one of the openings in the base, and stand means maintaining the base upright.

A further object of the present invention is to provide a one-piece molded construction of all plastic material comprising a base having two spaced apart openings therein and a stub shaft near each opening extending rearwardly away from the base, a pair of discs connected to the base each having an aperture therein to receive one of the stub shafts and frictionally to be maintained thereon, an instrument holder integral with the base comprising a cone-shaped bottom member extending forwardly away from the base, two arcuate strips one extending rearwardly and one forwardly of the base, and a ledge at the bottom of the holder extending away from the base opposite to the cone-shaped member, and an elongated rectangular member connected to the base by a discrete number of struts, at least one of the base and the rectangular member having spaced apart notches therein.

Another object of the present invention is to provide a one-piece unit of the type set forth in which a one-piece snap fit holder is removably joined to the base, and two paper discs are provided separate from the base and adapted to fit directly onto the stub shafts.

These and other objects of the present invention will be more readily understood by reference to the following specification taken in conjunction with the accompanying drawings, in which:

DESCRIPTION OF THE PREFERRED EMBODIMENT

Figure 1:
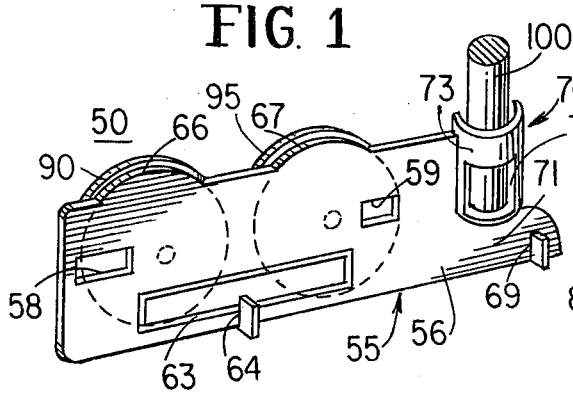
FIG. 1 is a front perspective view of the assembled desk set of the present invention with a writing instrument in the instrument holder.

Referring now to FIGS. 1 to 6 of drawings, there is disclosed an assembled desk set 50 comprised of a body 55 having a front surface 56 and a rear surface 57, spaced apart apertures 58 and 59 will serve, as will be explained, to illustrate the month and date respectively. On the front surface 56 centrally located, is a name plate area 63 which may be used either for a name plate, as will be illustrated, or may be used for a cartoon character (not shown). A notch 64 is located at the bottom edge of the base 55 substantially midway between the apertures 58 and 59.

Spaced apart arcuate top edges 66 and 67 are positioned inwardly respectively of the apertures 58 and 59 and extend beyond the flat portion of the top edge. An arcuate end tab 68 is at the right-hand end of the base 55 as illustrated in FIG. 1, and finally, there is a notch 69 dimensioned similarly to the notch 64, but located near the right-hand end of the base 55, as seen in FIG. 1.

An instrument holder 70 is located at the right-hand end of the base 55 and is integral therewith. As seen particularly in FIGS. 1, 2 and 4, the holder 70 is comprised of a forwardly extending cone-shaped portion 71 and vertically spaced apart but horizontally extending back and front straps 72 and 73, respectively. Two flat vertical side straps 74 interconnect the aforementioned cone-shaped portion 71 and the arcuate front 73 and rear 72 straps. A ledge 75 which is tapered from the front to the rear extends rearwardly from the base 55 and is positioned at the distal end of the cone-shaped member 71 to form a rest or support for a writing instrument 100 stored in the holder 70.

Figure 2:
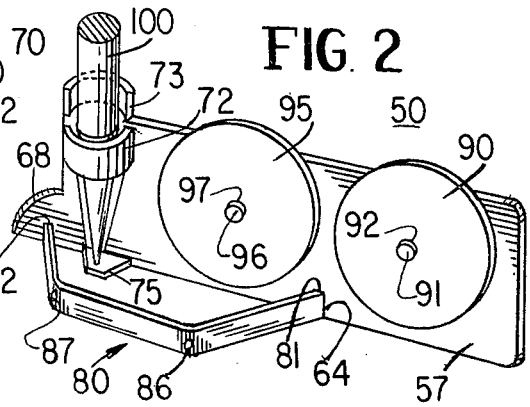
FIG. 2 is a rear perspective view of the desk set illustrated in FIG. 1.
Figure 3:
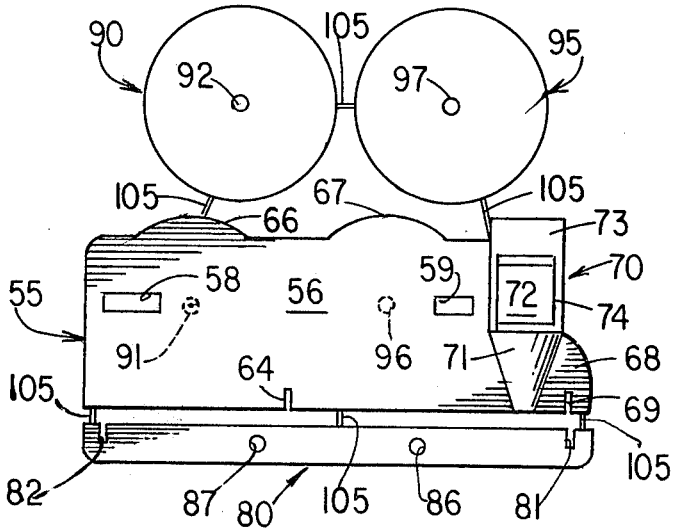
FIG. 3 is a front elevational view of the as molded one-piece construction which can readily be assembled into the desk set illustrated in FIG. 1.
Figure 4:
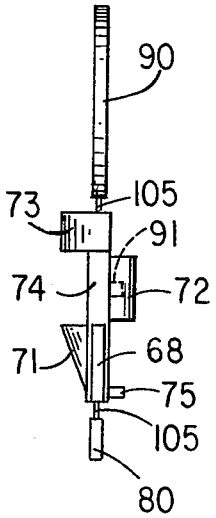
FIG. 4 is an end elevational view of the one-piece molded construction illustrated in FIG. 3 as viewed from the right-hand side thereof.
Figure 5:
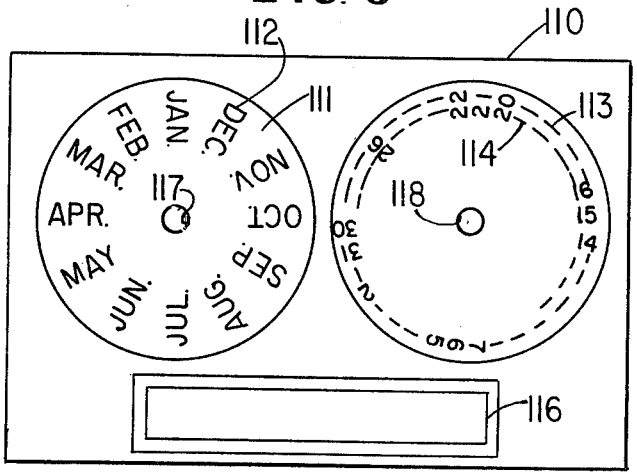
FIG. 5 is a front elevational view of a sheet containing decals for the month and date discs as well as a name plate decal for the front of the desk set illustrated in FIG. 1.

A stand 80 illustrated in FIGS. 1 and 2 is formed in the as molded construction illustrated in FIG. 3 as an integral part of the construction and, as illustrated in FIG. 3 initially is an elongated rectangular member having spaced apart notches 81 and 82 near the ends thereof and apertures 86 and 87 spaced apart and centrally located to influence a predetermined bend line in the stand 80, thereby to guarantee the configuration illustrated in FIGS. 1 and 2 when the stand 80 is detached and bent to provide a support for the assembled desk set 50. The stand 80 in use is generally U-shaped in plan view with the legs extending outwardly to the intersection between the stand 80 and the base 55. The notches 81 and 82 as well as notches 64 and 69 are respectively dimensioned to fit within each other as shown in FIGS. 1 and 2, thereby to provide a secure and steady support for the base 55. The dimensions of the notches 64, 69, 81 and 82 are such that not only are the notches frictionally engaged one with the other, but they are maintained therein securely to prevent the stand 80 from falling out of the base 55.

Connected to the base 55 are spaced apart discs 90 and 95. For reference, the disc 90 will be referred to as a month disc and the disc 95 as a date disc, but geometrically the discs are identical. The month disc 90 is mounted to the rear surface 56 of the base 55 by means of a spindle or stub shaft 91 extending rearwardly from the base and dimensioned to fit snugly within an aperture 92 centrally located in the disc 90. Similarly, the date disc 95 is rotatably mounted on a spindle or stub shaft 96 extending rearwardly from the rear surface 57 of the base 55, the spindle 96 fitting snugly within an aperture 97 centrally located within the disc 95. In the as molded single piece construction illustrated in FIG. 3, the discs 90 and 95 are connected to each other by means of a connecting gate 105 and connected to the arcuate edges 66 and 67 of the base 55 by means of connecting gates 105. Each of the aforementioned connecting gates 105 is of a small diameter and easily severed with a cutting tool such as a wire cutter. Similarly, the stand 80 is connected to the bottom of the base 55 by means of three spaced apart connecting gates 105, each of them dimensioned easily to be severed.

Included with the one-piece construction illustrated in FIG. 3 in the cereal box or other promoted item, is a sheet 110 having a decal 111 having indicia 112 illustrating the months radially positioned therearound. The decal 111 is provided with a central aperture 117 sized to fit around the aperture 92 in the month disc 90. Also on the sheet 110 is a decal 113 having indicia 114 in the form of numbers 1 to 31 radially spaced therearound to act as a date indicator. The decal 113 is provided with an aperture 118 centrally located thereof dimensioned to be in registry with the aperture 97 in the date disc 95. The decals 111 and 113 are of the type which are easily removed from the paper sheet 110 and then adhesively secured to one surface of the respective discs 90 or 95. Also provided on the sheet 110 is a rectangular decal 116 on which the ultimate user can write his or her name, which name plate decal 116 is dimensioned to fit within the rectangular space 63 on the center, centrally located on the front surface 56 of the base 55.

Certain features of the one-piece molded construction illustrated in FIG. 3 or the assembled desk set 50 illustrated in FIGS. 1 and 2, are extremely important for premium feasibility. First and foremost, is that the one-piece construction of FIG. 3 is inexpensive to produce, easy to construct, light weight and passes FDA size requirements for toys. The only assembly required is to detach and assemble the stand 80, detach the discs 90 and 95 and thereafter to secure the decals 111 and 113 respectively on the discs and if supplied to secure the name plate 116 to the area 63. All of this can be accomplished by a child of tender years, and therefore, the desk set 50 is a highly desirable premium item.

Figure 6:
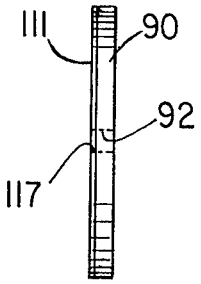
FIG. 6 is a side elevational view of a month or date disc having the appropriate decal thereon.

In operation, the decals 111 and 113 are mounted on their respective discs 90 and 95 as illustrated in FIG. 6, and the respective discs are then frictionally engaged onto the stub shafts 91 and 96. The friction fit between the discs 90 and 95 and the respective shafts 91 and 96 is such that the discs are maintained on the shaft and do not freely rotate so that manual action is necessary to rotate the discs.

The instrument holder 70 is of a unique design and one which is specifically adapted to the molding process used to produce the present invention and is necessary in order to reduce the tooling cost and to increase the molding speed. The holder 70 as previously discussed is made of vertically spaced apart oppositely extending arcuate straps 72 and 73 and a forwardly extending cone-shaped member 71 which in cooperation with the rearwardly extending ledge 75 serves to hold a writing utensil such as a pencil 100 in the holder 70. In order rapidly to mold the desk set 50, it is necessary that the rearwardly extending strap 72 have the upper edge thereof slightly below the lower edge of the forwardly extending strap 73. Further, the lower edge of the rearwardly extending strap 72 must be vertically above the upper edge of the cone-shaped member 71 all as seen in FIG. 3. Preferably, the ledge 75 is dimensioned to lie substantially in registry with the boundary of the arc formed by the arcuate member 72.

The notches 81 and 82 in the stand 80 are dimensioned to fit respectively in the notches 64 and 69 in the base 55, thereby to provide a secure fit between the stand 80 and the base 55. Stability of the desk set 50 is dependent on the stand 80, and therefore, it is imperative that the stand snugly fit into and be maintained in the base 55. The apertures 86 and 87 formed within the stand 80 during the molding thereof influence preselected bend lines in the stand 80 which facilitates the bending of the stand along the creased lines passing through the apertures to provide the assembled construction illustrated in FIGS. 1 and 2.

The extension 68 to the base 55 is required to provide the necessary stability to the assembled desk set 50. In use, the lever arm of the utensil 100 in combination with the designed light weight makes the stand 80 only function if the length between the notches 64 and 69 is longer than normally possible. By expanding the base 55 with the extension 68, the required expanded length between the notches 64 and 69 was obtained and the desk set 50 is stable.

While some of the features discussed above may be omitted, the combination thereof results in the one-piece construction of FIG. 3, which is easily constructed into the finished desk set 50 of FIGS. 1 and 2, which achieves all of the objects and provides all the advantages hereinbefore discussed.

Referring now to FIGS. 7 to 13 of the drawings, there is disclosed as a second embodiment of the invention an assembled desk set 150 comprised of a body 155 having front surface 156 and a rear surface 157, spaced apart apertures 158 and 159 serve to illustrate the month and date, respectively. A notch 164 is located at the bottom edge of the base 155 substantially midway between the apertures 158 and 159.

Spaced apart arcuate top edges 166 and 167 are positioned inwardly respectively of the apertures 158 and 159 and extend beyond the flat portion of the top edge. An arcuate end tab 168 is at the right-hand end of the base 155 as illustrated in FIG. 7, and finally, there is a notch 169 dimensioned similarly to the notch 164, but located near the right-hand end of the base 155.

An instrument holder 170 is located at the right-hand end of the base 155 and is integral therewith. As seen particularly in FIGS. 7, 8 and 10, the holder 170 is comprised of a forwardly extending cone-shaped portion 171 and vertically spaced apart but horizontally extending back and front straps 172 and 173, respectively. Two flat vertical side straps 174 interconnect the aforementioned cone-shaped portion 171 and the arcuate front 173 and rear 172 straps. A ledge 175 which is tapered from the front of the rear extends rearwardly from the base 155 and is positioned at the distal end of the cone-shaped member 171 to form a rest or support for a writing instrument 100 stored in the holder 170.

Figure 7:
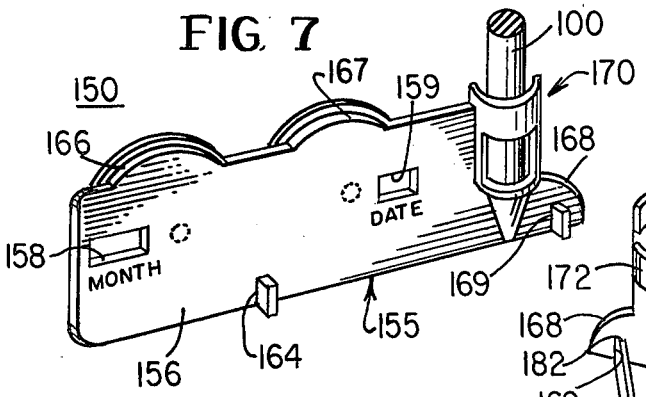
FIG. 7 is a front perspective view of another embodiment of the present invention.
Figure 8:
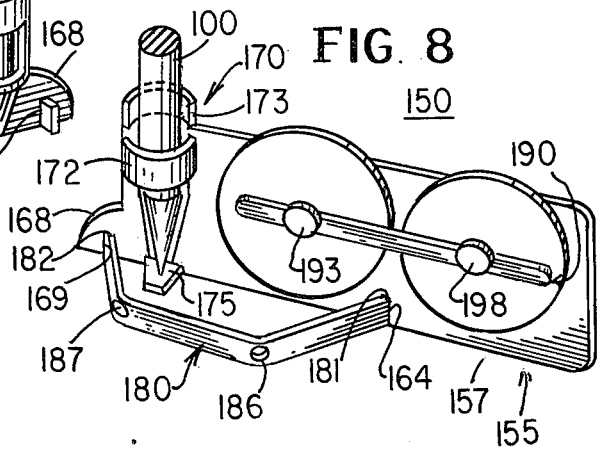
FIG. 8 is a rear perspective view of the desk set illustrated in FIG. 7.
Figure 9:
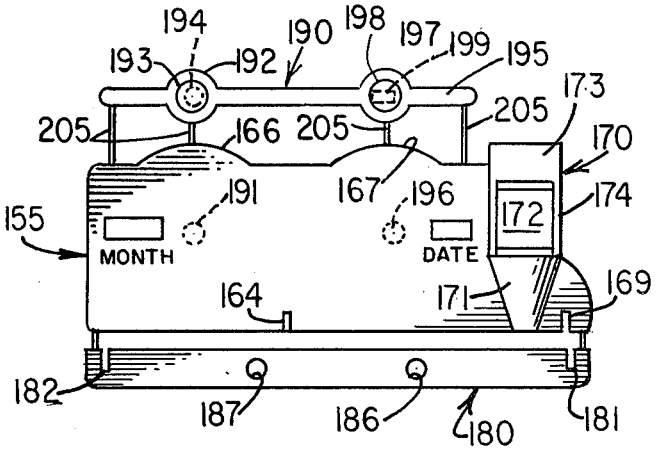
FIG. 9 is a front elevational view of the one-piece or as molded construction which can be assembled into the device illustrated in FIG. 7.
Figure 10:
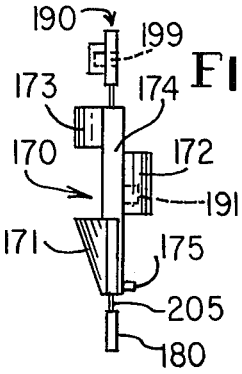
FIG. 10 is a right side elevational view of the desk set illustrated in FIG. 7.
Figure 11:
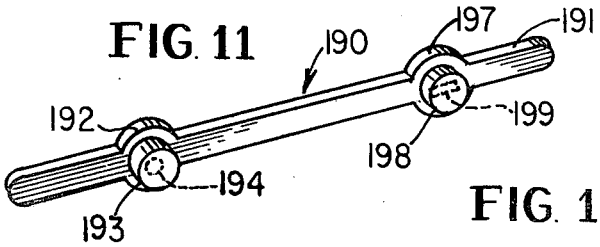
FIG. 11 is a perspective view of the one-piece holder illustrated in FIG. 9.
Figure 12:
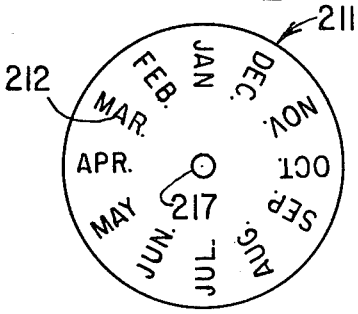
FIGS. 12 and 13 are front elevational views of the paper discs carrying indicia thereon.
Figure 13:
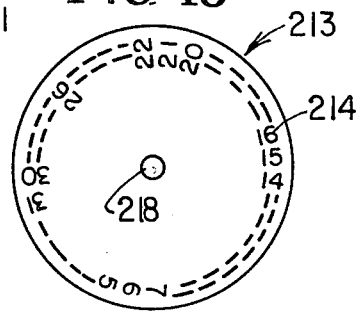

A stand 180 illustrated in FIGS. 7 and 8 is formed in the as molded construction illustrated in FIG. 9 as an integral part of the construction and initially is an elongated rectangular member having spaced apart notches 181 and 182 near the ends thereof and apertures 186 and 187 spaced apart and centrally located to influence a predetermined bend line in the stand 180, thereby to guarantee the configuration illustrated in FIGS. 7 and 8 when the stand 180 is detached and bent to provide a support for the assembled desk set 150. The stand 180 in use is the same as stand 80 previously described.

Connected to the base 155 is a support strap or strut 190 having a generally rectangular body 195 with two circular enlargements 192 and 197 spaced apart and integral with the body 191. Integral with but extending outwardly from the enlargements 192 and 197 are annular friction caps 193 and 198, respectively, sized to frictionally engage, respectively, rearwardly extending stub shafts 191 and 196 extending rearwardly from the base 155. Each of the friction caps 193 and 198 have an aperture therein, respectively 194 and 199, with the aperture 194 being elongate to accommodate any difference in shrinkage between the strap 190 and the body 155 after molding.

In the as molded single piece construction illustrated in FIG. 9, the support strap 190 is connected to the arcuate edges 166 and 167 of the base 155 by means of connecting gates 205, four being shown. Each of the aforementioned connecting gates 205 is of a small diameter and easily severed with a cutting tool such as a wire cutter. Similarly, the stand 180 is connected to the bottom of the base 155 by means of two spaced apart connecting gates 205, each of them dimensioned easily to be severed.

Included with the one-piece construction illustrated in FIG. 9 in the cereal box or other promoted item, is a circular cardboard or rigid paper disc 211 having indicia 212 illustrating the months radially positioned therearound. The disc 211 is provided with a central aperture 217 sized to fit around the stub shaft 191. Also provided is another circular cardboard or rigid paper disc 213 having indicia 214 in the form of numbers 1 to 31 radially spaced therearound to act as a date indicator. The disc 213 is provided with an aperture 218 centrally located thereof dimensioned to fit around the stub shaft 196. The support strap 190 securely maintains the discs 211 and 213 in place after mounting on the stub shafts 191 and 196, respectively, by snap fitting onto the stub shafts.

Features of the one-piece molded construction illustrated in FIG. 9 or the assembled desk set 150 illustrated in FIGS. 7 and 8, are extremely important for premium feasibility, as were these features for embodiment 50, and will not be reiterated, but nevertheless pertain to this embodiment.

In operation, the embodiment 150 operates in the same manner as previously described embodiment 50, with the importance of the instrument holder 170 and the stand 180 being essentially the same.

While some of the features discussed above may be omitted, the combination thereof results in the one-piece construction of FIGS. 3 and 9 which is easily constructed into the finished desk set 50 of FIGS. 1 and 2, and 150 of FIGS. 7 and 8, achieves all of the objects and provides all the advantages hereinbefore discussed.

While there has been disclosed what at present are considered to be the preferred embodiments of the present invention, it will be understood that various modifications and alterations may be made therein without departing from the true spirit and scope of the present invention, and it is intended to cover within the appended claims all such alterations and modifications.

What is claimed is:

1. A desk set of all plastic material, comprising a base having spaced apart notches in the bottom thereof and two spaced apart openings therein and a stub shaft near each opening extending rearwardly away from said base, an instrument holder near one end of said base and integral therewith, said holder comprised of spaced apart vertically extending straps interconnected by two horizontally positioned discrete and oppositely facing arcuate strips defining a forwardly facing window, an inverted hollow cone-shaped member forming the bottom of said holder having a generally arcuate surface extending outwardly from the front surface of said base and a ledge extending rearwardly from the bottom of said cone-shaped member, two discs carrying thereon indicia indicating the month and day for rotatably mounting to said base such that a portion of each disc is visible through one of said openings in said base, means maintaining the disc mounted on said base and stand means consisting of a unitary rectangular strip having notches therein near each end thereof for mounting respectively in said base notches maintaining said base upright, said strip having two apertures therein defining bend lines.

2. The desk set of claim 1, wherein said discs are plastic and said maintaining means is the friction fit between said plastic discs and said stub shafts.

3. The desk set of claim 2, and further comprising a pair of circular decals, one having the months radially spaced therearound and one having the numerals one to thirty-one radially spaced therearound, said decals dimensioned to fit on said discs.

4. A one-piece construction of all plastic material, comprising a base having two spaced apart openings therein and a stub shaft near each opening extending rearwardly away from the base, an instrument holder integral with said base comprising a cone-shaped bottom member having an arcuate surface extending forwardly away from said base, two discrete vertically spaced apart arcuate strips one extending rearwardly and one forwardly to said base defining a forwardly facing window, and a ledge at the bottom of said holder extending away from said base opposite to said cone-shaped member, and an elongated rectangular member having spaced apart apertures therein connected to said base by a discrete number of struts, at least one of said base and said rectangular member having spaced apart notches therein.

5. The one-piece molded construction set forth in claim 4, wherein each of said base and said rectangular member has two spaced apart notches therein.

6. The one-piece molded construction set forth in claim 4, and further comprising a pair of discs connected to said base each having an aperture therein to receive one of said stub shafts and frictionally to be maintained thereon.

7. The one-piece molded construction set forth in claim 4, and further comprising a pair of annular caps connected to said base and each having an aperture therein to receive one of said stub shafts and frictionally to be maintained thereon.

8. The one-piece molded construction set forth in claim 7, wherein said annular caps are carried by a single strut.

* * * * *